US005570715A

United States Patent [19]

Featheringill et al.

[11] Patent Number: 5,570,715

[45] Date of Patent: Nov. 5, 1996

[54] SUMP-VENTED CONTROLLER MECHANISM FOR VACUUM SEWERAGE TRANSPORT SYSTEM

[75] Inventors: Burton A. Featheringill; John M. Grooms, both of Rochester, Ind.

[73] Assignee: Airvac, Inc., Rochester, Ind.

[21] Appl. No.: 429,536

[22] Filed: Apr. 26, 1995

[51] Int. Cl.[6] ..... E03B 5/00

[52] U.S. Cl. ..... 137/205; 137/236.1; 137/907

[58] Field of Search ..... 137/205, 236.1, 137/907

[56] References Cited

U.S. PATENT DOCUMENTS 3,115,148 12/1963 Liljendahl .
3,730,884 5/1973 Burns et al. .
4,171,853 10/1979 Cleaver et al. .
4,179,371 12/1979 Foreman et al. .
4,373,838 2/1983 Foreman et al. .
4,691,731 9/1987 Grooms et al. .
5,078,174 1/1992 Grooms et al. .
5,082,238 1/1992 Grooms et al. .

*Primary Examiner*—Gerald A. Michalsky
*Attorney, Agent, or Firm*—Jones, Day, Reavis & Pogue

[57] ABSTRACT

An apparatus for preventing waterlogging of the sensor and controller valves used to regulate operation of the vacuum interface valve in a sump vented vacuum sewerage system. A float valve operates in accordance with the sewage level in a sump pit and communicates atmospheric pressure to the sensor and controller valves while the sewage level is below a predetermined limit, but closes passage of sewage therethrough once the sewage level exceeds the predetermined limit. A pressure-relief valve may also be operatively connected to the float valve that vents excessive hydrostatic pressure buildups in the sump pit to the atmosphere.

15 Claims, 9 Drawing Sheets

SUMP-VENTED CONTROLLER MECHANISM FOR VACUUM SEWERAGE TRANSPORT SYSTEM

BACKGROUND OF THE INVENTION

The present invention relates generally to vacuum sewerage transport systems for conveying sewage collected in a holding sump to a downstream collection vessel maintained under the influence of vacuum or subatmospheric pressure, and more specifically to a differential pressure-operated controller mechanism for such a system that is free of externally mounted breather pipes, and is protected from waterlogging and hydrostatic pressure buildups.

Sewerage systems are commonly used to transport sewage and other waste liquids from a source, such as a residential or commercial establishment, to a collection vessel, whereupon the material is treated for subsequent disposal. The sewage is transported within an underground pipe network. Provided that the pipes can be laid in a continuous downhill slope, the sewage can be transported to the collection vessel by means of gravity. Often, however, one or more pumping stations are necessary to push the sewage by means of positive pressure through pipes elevated to avoid rocks, pipes, and other underground barriers, or to reduce the depth to which the pipes of a completely gravity-oriented system would need to be buried. In many instances, a positive pressure sewage system is used in which the pipes are laid largely without regard to topographical features, relying instead entirely upon pressure pumps located at every sewage input point to propel the sewage to the collection vessel.

Becoming increasingly popular are vacuum sewage systems, wherein sewage at atmospheric pressure is moved by means of differential pressure through a transport conduit maintained at vacuum or subatmospheric pressure by means of a vacuum pump operatively connected to the collection vessel. As shown more fully in FIG. 1, vacuum sewerage system 10 comprises a sump pit 12 buried beneath ground level 13 to which are connected a plurality of gravity lines 14 emanating from sewage sources 16. External gravity vent 18 positioned above ground ensures that sewage reaches sump pit 12 at atmospheric pressure.

Located above ground a distance away is a vacuum collection station containing a collection vessel 20 maintained at vacuum or subatmospheric pressure by means of vacuum pumps. Vacuum collection vessel 20 is operatively connected to sump pit 12 by means of a vacuum transport conduit 22. The vacuum transport conduit may be laid in a number of configurations. For example, it may be provided with "pockets" in which the sewage is collected so as to form a plug that entirely fills the cross-sectional bore of the conduit. The sewage plug is moved by means of differential pressure through the conduit in an integral condition. U.S. Pat. No. 3,115,148 issued to Liljendahl, and U.S. Pat. No. 3,730,884 issued to Burns et al. disclose such "plug-flow" systems. More preferably, the conduit portion leading to each pocket or low point is sloped such that the low point will not be filled with sewage upon completion of a sewage transport cycle, and an equalized vacuum or subatmospheric pressure condition is communicated instead throughout the conduit network. As taught by U.S. Pat. No. 4,179,371 issued to Foreman et al., a sewage/ air mixture in such a "two-phase flow" system is swept along the conduit during a transport cycle, so that the sewage can travel a greater distance than is possible with a plug-flow system.

A top panel 24 of sump pit 12 is connected to the sidewalls thereof in a sealed relationship in order to provide a pressure-tight vessel. Positioned on top of the top panel 24 is valve pit 26, which is accessed at ground level by a manhole cover 28. Located within valve pit 26 is vacuum interface valve 30. Examples of interface valves may be found in U.S. Pat. No. 4,171,853 issued to Cleaver et al., and U.S. Pat. Nos. 5,078,174 and 5,082,238 issued to Grooms et al, as well as U.S Ser. No. 07/829,742, now U.S. Pat. No. 5,259,427 07/967,454, now U.S. Pat. No. 5,326,069 and 08/008,190, now U.S. Pat. No. 5,282,281, owned by the assignee of the present invention. As shown generally in FIG. 2, it comprises a wye-body conduit 32 having an inlet 34 which is operatively connected to sump pit 12 by means of suction pipe 36, and an outlet 38, which is operatively connected to vacuum transport conduit 22. Positioned within valve housing 40 is plunger 42, which may be conically shaped. An elastomeric seat 44 is attached to one end of plunger 42, and cooperates with valve stop 46 of wye-body conduit 32 to regulate passage of sewage through interface valve 30. Secured to the top of valve housing 40 is lower housing 48 and upper housing 50, which are divided by means of elastomeric diaphragm 52. Lower housing 48 is always maintained at atmospheric pressure by means of externally mounted breather pipe 54 and atmospheric hose 56. Plunger 42 is connected to piston cup 58 by means of piston shaft 60, and a spring 62 positioned between the interior of piston cup 58 and the top of upper housing 50 biases valve seat 44 against valve stop 46 to close interface valve 30 when upper housing 50 is at atmospheric pressure. However, once upper housing 50 is switched to a vacuum or subatmospheric pressure condition, diaphragm 52—and consequently piston cup 58, piston shaft 60, plunger 42, and valve seat 44—is moved away from valve stop 46 by means of differential pressure to open interface valve 30 to commence a sewage transport cycle.

Sensor-controller 66 is used to deliver a vacuum/subatmospheric or atmospheric pressure condition to upper housing 50 so to open or close interface valve 30 in response to the sewage level in sump pit 12. The structure of sensor-controller 66 is described more fully in U.S. Pat. No. 4,373,838 issued to Foreman et al. As shown in FIGS. 3–4, however, the structure and mode of operation is generally as follows. A plurality of body elements 68, 70, 72, 74, and 76 cooperate to form hydrostatic pressure chamber 78, sensor chamber 79, chamber 80, chamber 81, vacuum chamber 82, and valve chamber 84. Chambers 78 and 79 are divided by means of elastomeric diaphragm 86. Chambers 79 and 80 communicate by means of port 88, which may be closed by spring biased lever valve 90 (see FIG. 3). Chambers 80 and 81 are divided by means of elastomeric diaphragm 92 to which is attached piston rod 94 that extends through chamber 81, chamber 82, and into chamber 84. Vacuum chamber 82 is maintained at vacuum or subatmospheric pressure by means of vacuum inlet port 96 and vacuum hose 98 which is attached to vacuum transport conduit 22. Surge tank 100 may be interposed in vacuum hose 98 to prevent sewage from entering vacuum chamber 82. Atmospheric inlet port 102 delivers atmospheric pressure to sensor-controller 66 by means of atmospheric hose 56 connected to external breather pipe 54. Atmospheric pressure, in turn, is delivered to sensor chamber 79 by means of inlet 104 and atmospheric conduit 106.

To the other end of piston rod 94 is connected three-way valve seat 108 made from a plastic material. Flange 110 on valve seat 108 is positioned between elastomeric seals 112 and 114 which communicate vacuum/subatmospheric and atmospheric pressure from vacuum chamber 82 and atmospheric inlet port 102, respectively, to valve chamber 84.

Sensor-controller 66 is shown in the closed position in FIG. 3. Hose 116 operatively connected to sensor pipe 37 communicates the hydrostatic pressure level in sump pit 12 to chamber 78 through inlet port 118. Meanwhile, sensor chamber 79 is at atmospheric pressure. The vacuum/subatmospheric pressure condition of vacuum chamber 82 is communicated to chambers 80 and 81 by means of vacuum conduit 120. Flange 110 of valve seat 108 closes vacuum vent 112, and opens atmospheric vent 114 to allow atmospheric pressure to pass into valve chamber 84, and therefore into upper valve housing 50 through pressure vent 122.

Once the hydrostatic pressure communicated to chamber 78 rises to a predetermined level, however, diaphragm 86 is biased into contact with lever valve 90, which in turn is activated to open port 88 so that the vacuum/subatmospheric pressure in chamber 80 is replaced with the atmospheric pressure condition of sensor chamber 79 (see FIG. 4). This creates a differential pressure across diaphragm 92, which pushes piston rod 94 so that valve flange 110 closes atmospheric vent 114 and opens vacuum vent 112, whereupon vacuum/subatmospheric pressure is delivered into vacuum chamber 84, and through pressure vent 122 into upper valve housing 50 to open interface valve 30 to commence a sewage transport cycle. Meanwhile, vacuum/subatmospheric pressure in vacuum chamber 82 is leaked through vacuum conduit 120 into chamber 80 to replace the atmosphere pressure therein, and once it reaches a sufficient level, the process is reversed to return sensor-controller 66 to once again closed position shown in FIG. 3 to terminate the sewage transport cycle.

It has been found, however, that the above-ground breather pipe 54 provides several disadvantages. First, unlike gravity vent 18 which may be conveniently positioned against building 16 in a secluded state, valve pit 26 is typically located out in a yard or field, so the associated breather pipe 54 cannot be so easily hidden, and therefore is aesthetically displeasing. Second, because of its open, unprotected position, above-ground breather pipe 54 may be subject to vandalism or damage by a lawn mower, car, etc. This disrupts the reliable supply of atmospheric pressure to sensor-controller 66 and interface valve 30 required for their proper operation.

Consequently, U.S. Pat. No. 4,691,731 issued to Grooms et al. teaches a sump/valve pit structure 130, as shown in FIG. 5, in which breather pipe 54 is eliminated, and instead, atmospheric pressure is supplied by sump pit 12. More specifically, sensor pipe 37 is secured to sump pit top panel 24 by means of a sleeve 132 and collar 134 assembly. Collar 134 has three nozzles 136, 138, and 140 extending therefrom (see FIG. 5*a*). Breather tube 142 is attached to nozzle 136 and atmospheric inlet port 102 of sensor-controller 66 (FIGS. 3 & 4), thereby allowing atmospheric pressure contained in sump pit 12 to be freely communicated to the sensor-controller. Vent tube 144, in turn, is attached to nozzle 138 and lower housing 48 of interface valve 30, thereby providing atmospheric pressure thereto. Finally, drainage tube 146 may be attached to lower housing 48 and nozzle 140, ensuring that any moisture that condenses within lower housing 48 may be easily drained back through sensor pipe 37 into sump pit 12. Under normal operating conditions, this "in pit breather" arrangement provides atmospheric pressure to sensor-controller 66 and interface valve 30 without above-ground breather pipe 54.

Problems arise, however, if the vacuum/subatmospheric pressure condition within vacuum transport conduit 22 diminishes to a low vacuum condition. Referring to FIGS. 3–4, once the hydrostatic pressure condition delivered to chamber 78 by sensor pipe 37 and pressure tube 116 reaches the predetermined level as sewage accumulates in sump pit 12, diaphragm 86 is biased to open lever valve 90, and chamber 80 is converted to atmospheric pressure (i.e., 0 vacuum), while chamber 81 is at low vacuum. The differential pressure across valve diaphragm 92 is too small to overcome the counterforce exerted by spring 95 to move piston rod 94 and valve head 108 sufficiently to completely close off atmospheric vent 114. Moreover, the low vacuum pressure passed through vacuum vent 112 and pressure vent 122 into upper housing 50 is insufficient to open interface valve 30. Not only can sewage not be evacuated from sump pit 12 through suction pipe 36 and closed interface valve 30 to vacuum transport conduit 22, but also sewage continues to collect in the sump.

Once the sewage level in sump pit 12 rises to a sufficient level, positive pressure therein pushes sewage through breather tube 142 to atmospheric inlet port 102 of sensor-controller 66. The atmospheric pressure in sensor valve chamber 79 will temporarily keep the sewage from entering it via atmospheric conduit 106. However, once lever valve 90 is opened when the sensor-controller valve is fired, atmospheric pressure leaks from sensor valve chamber 79 into chamber 80. Moreover, atmospheric pressure can leak from sensor valve chamber 79 through vacuum conduit 120, vacuum hose 98, and surge tank 100 into vacuum transport conduit 22. By reducing the atmospheric pressure condition in sensor valve chamber 79, sewage may now enter it and the rest of the sensor-controller chambers through the aforementioned paths to ensure that sensor-controller 66 cannot operate properly until it is manually drained by service personnel.

Thus, U.S. Pat. No. 4,691,731 also discloses a sump-vent valve which may be interposed within vacuum hose 98, and is closed by a low vacuum condition to prevent communication of the low vacuum to sensor-controller 66 which can cause atmospheric pressure in sensor valve chamber 79 to leak, and thereby compromise the sealed nature of chamber 79 that otherwise keeps sewage out of sensor-controller 66.

It has been found, however, that there are several problems that can seriously thwart the operation of sensor-controller 66 and interface valve 30 that are not rectified by the sump-vent valve. First, the sump-vent valve is initially set to close at the correct time once a low vacuum pressure condition arises. For example, if 5 inches of vacuum is required to operate sensor-controller 66, and the sump-vent valve is set to close at 6 inches of vacuum, then the system works. However, if over time the sump-vent valve begins to close at 4½ inches of vacuum, then it is not activated soon enough as the vacuum pressure within the system 10 drops, and low vacuum can be communicated to sensor-controller 66 to allow sewage to enter it, despite the presence of the sump-vent valve.

Second, even if the sump-vent valve operates properly, once full vacuum is restored to the system, sensor-controller 66 will be activated to the open position in response to the elevated hydrostatic pressure condition already stored in chamber 78. Some atmospheric pressure will be consumed in the process, which will cause sewage to be pulled through breather tube 142 into sensor-controller 66.

Third, breather tube 142 is connected to the top of sensor pipe 37 that extends through sump pit top 24. If the seal between sleeve 132 and top 24 fails, then atmospheric pressure can leak out of sump pit 12 into valve pit 26. This permits even more sewage to collect in sump pit 12 if the low vacuum condition that renders sensor-controller 66 and interface valve 30 inoperative by the sump-vented valve persists over an extended period of time. Once full vacuum is restored, and sensor-controller 66 is activated, enough atmospheric pressure can leak within sensor-controller 66 to draw sewage into it, as previously described.

Another problem arises if gravity line 14 is installed improperly or settles over time to create a dip therein. If the cross-sectional bore of the dipped portion becomes filled with sewage, then atmospheric pressure from gravity vent pipe 18 cannot be communicated to sump pit 12 to be passed to sensor-controller 66 and interface valve 30. This could prevent the sensor-controller and interface valve from operating properly. Furthermore, if hydrostatic pressure builds sufficiently in sump pit 12, then it, and not atmospheric pressure, can be communicated to atmospheric inlet port 102 of sensor-controller 66. Thus, hydrostatic pressure would be communicated to both ends of sensor-controller 66, and then to chambers 78 and 79, which would render sensor-controller 66 completely inoperative.

SUMMARY OF THE INVENTION

Accordingly, it is an object of the present invention to provide a control mechanism for a sump-vented vacuum sewerage transport system that prevents sewage from being drawn there, to render it inoperative during extended low vacuum pressure conditions.

Another object of the present invention is to provide such a control mechanism that prevents hydrostatic pressure within the sump pit from being communicated to both ends of the control mechanism to render it inoperative.

Yet another object of the present invention is to provide such a modified control mechanism that is relatively simple in design.

Other objects of the invention, in addition to those set forth above, will become apparent to those skilled in the art from the following disclosure.

Briefly, the invention is directed to providing an apparatus for preventing waterlogging of the sensor and controller valves used to regulate operation of the vacuum interface valve in a sump vented vacuum sewerage system. A float valve operates in accordance with the sewage level in a sump pit and communicates atmospheric pressure to the sensor and controller valves while the sewage level is below a predetermined limit, but closes passage of sewage therethrough once the sewage level exceeds the predetermined limit. A pressure-relief valve may also be operatively connected to the float valve that vents excessive hydrostatic pressure buildups in the sump pit to the atmosphere.

Figure 5A:
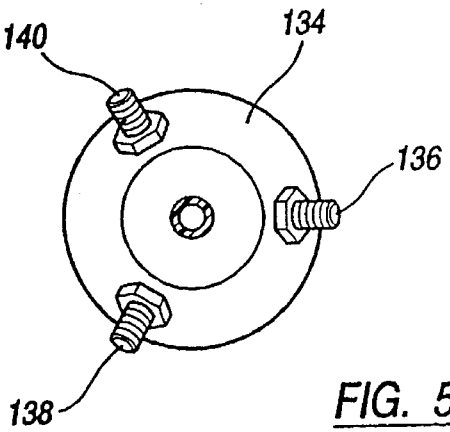
FIG. 5 is a diagrammatic representation of a prior art vacuum sewerage transport system containing an interface valve, sensor-controller, and in-pit breather system.
Figure 5:
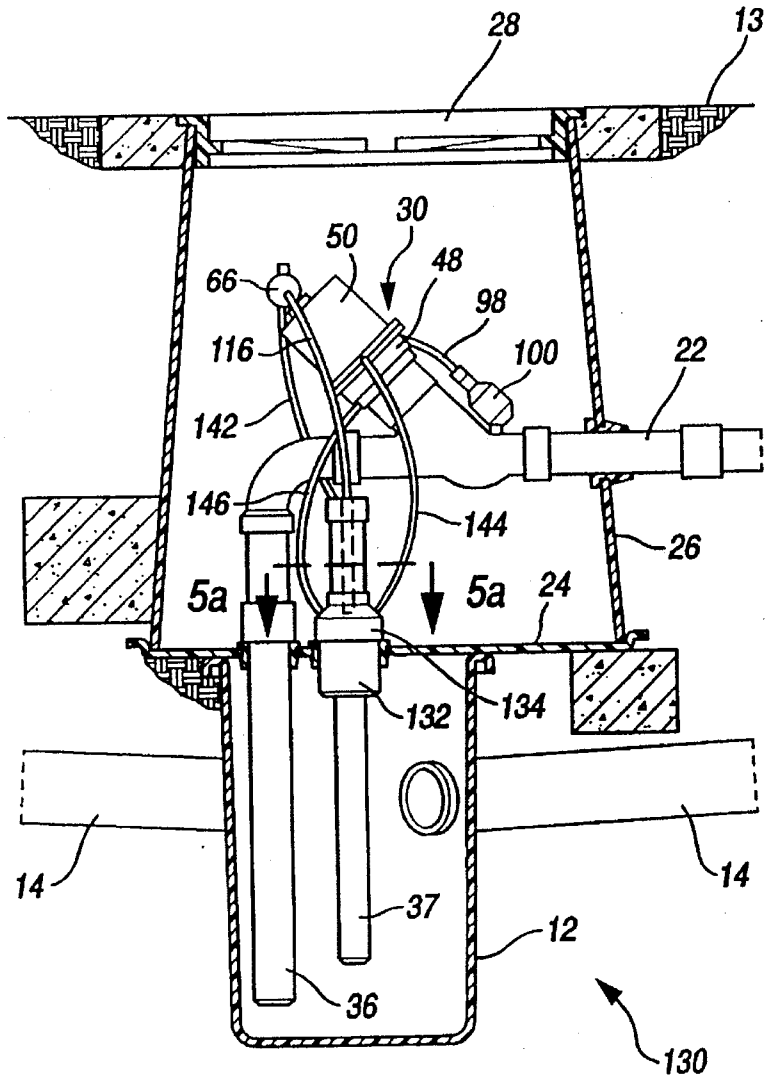
FIG. 5 PRIOR ART

FIG. **5*a* is a plan view of the in-pit breather system collar of FIG. 5 taken along line *5a–5a;***

Figure 6:
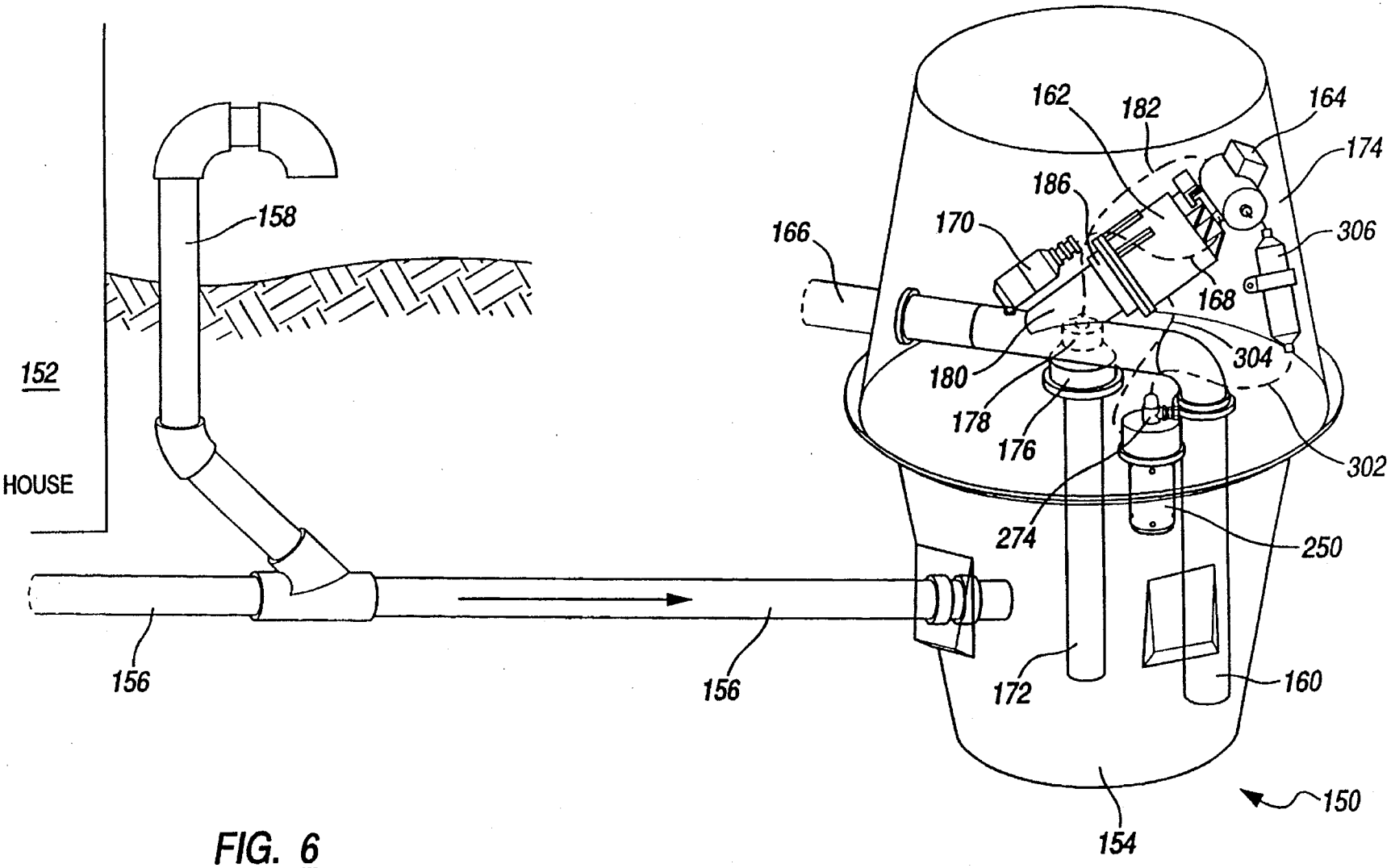
Figure 7:
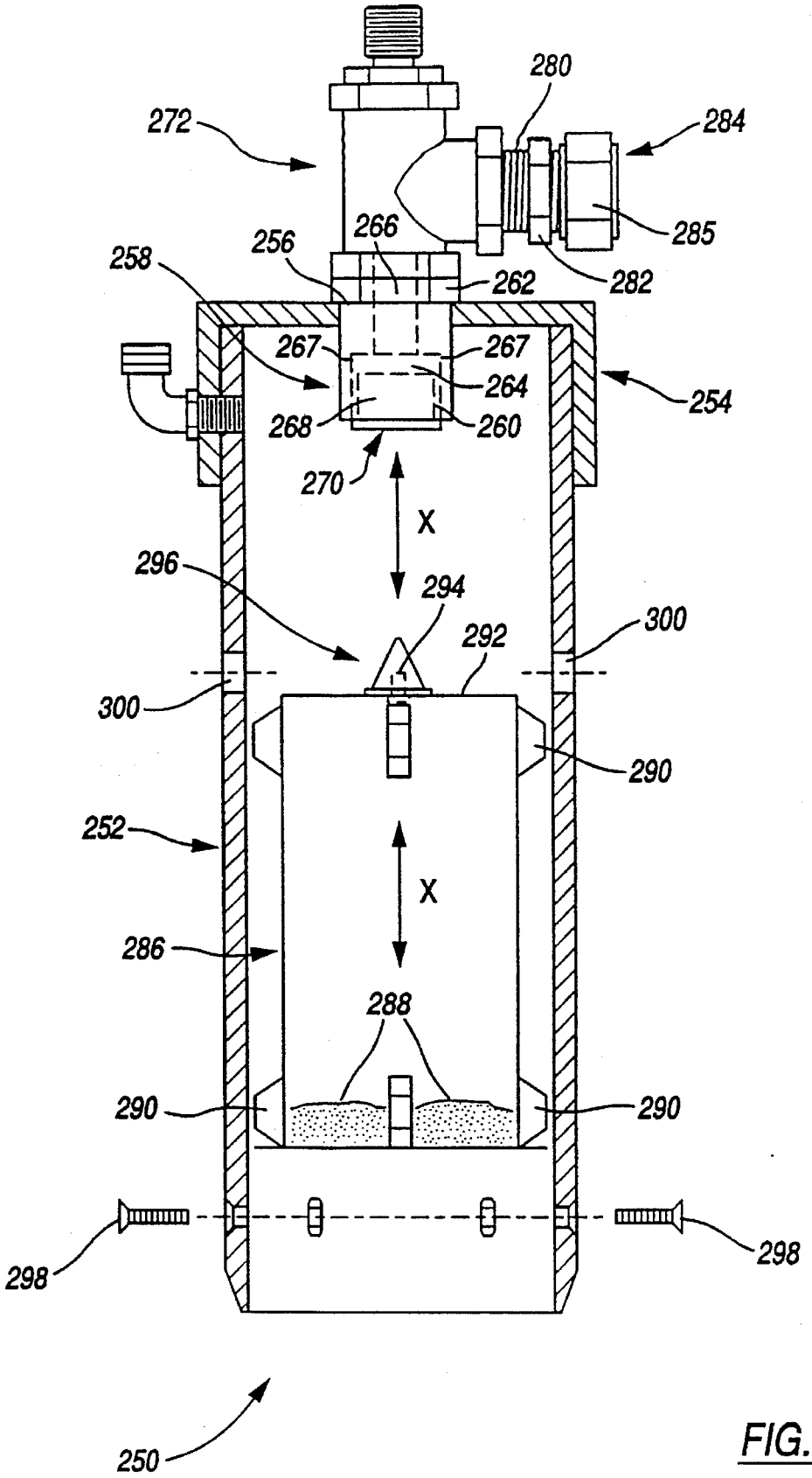
Figure 8:
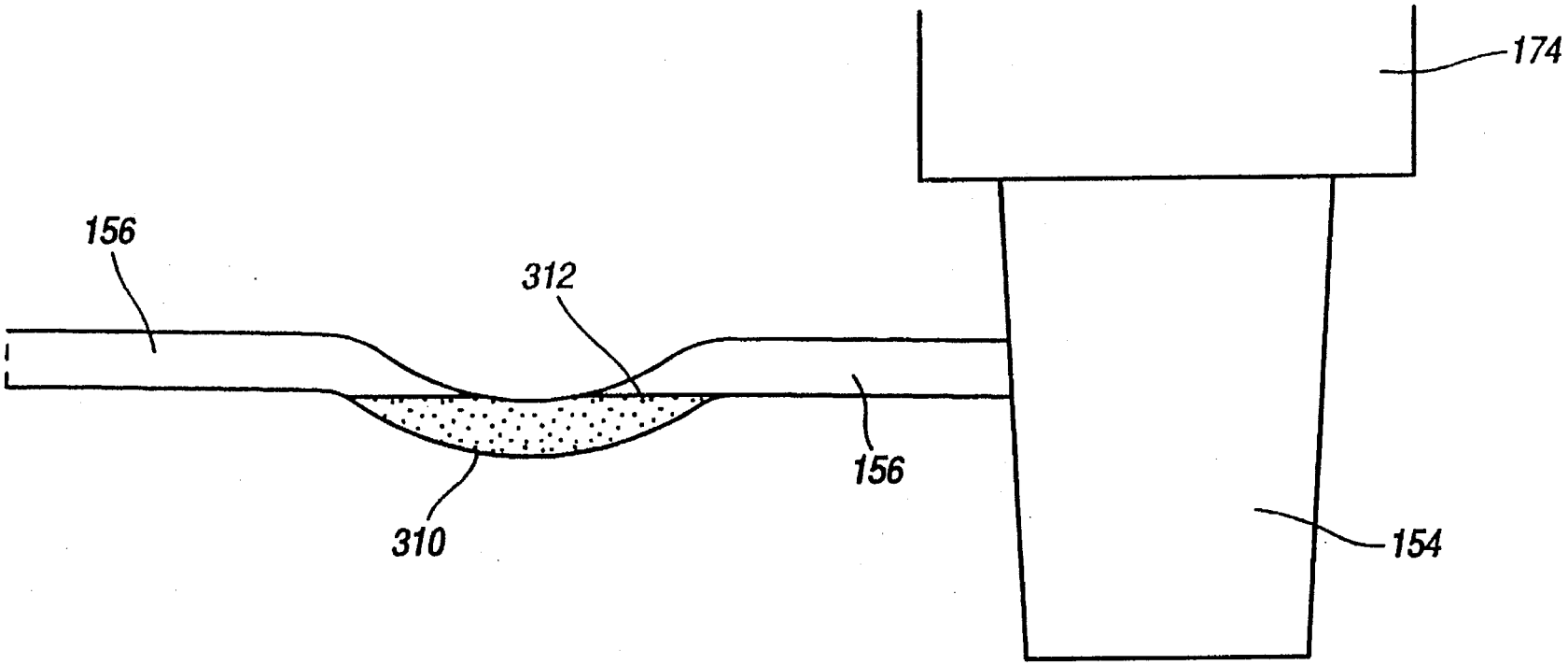
Figure 9:
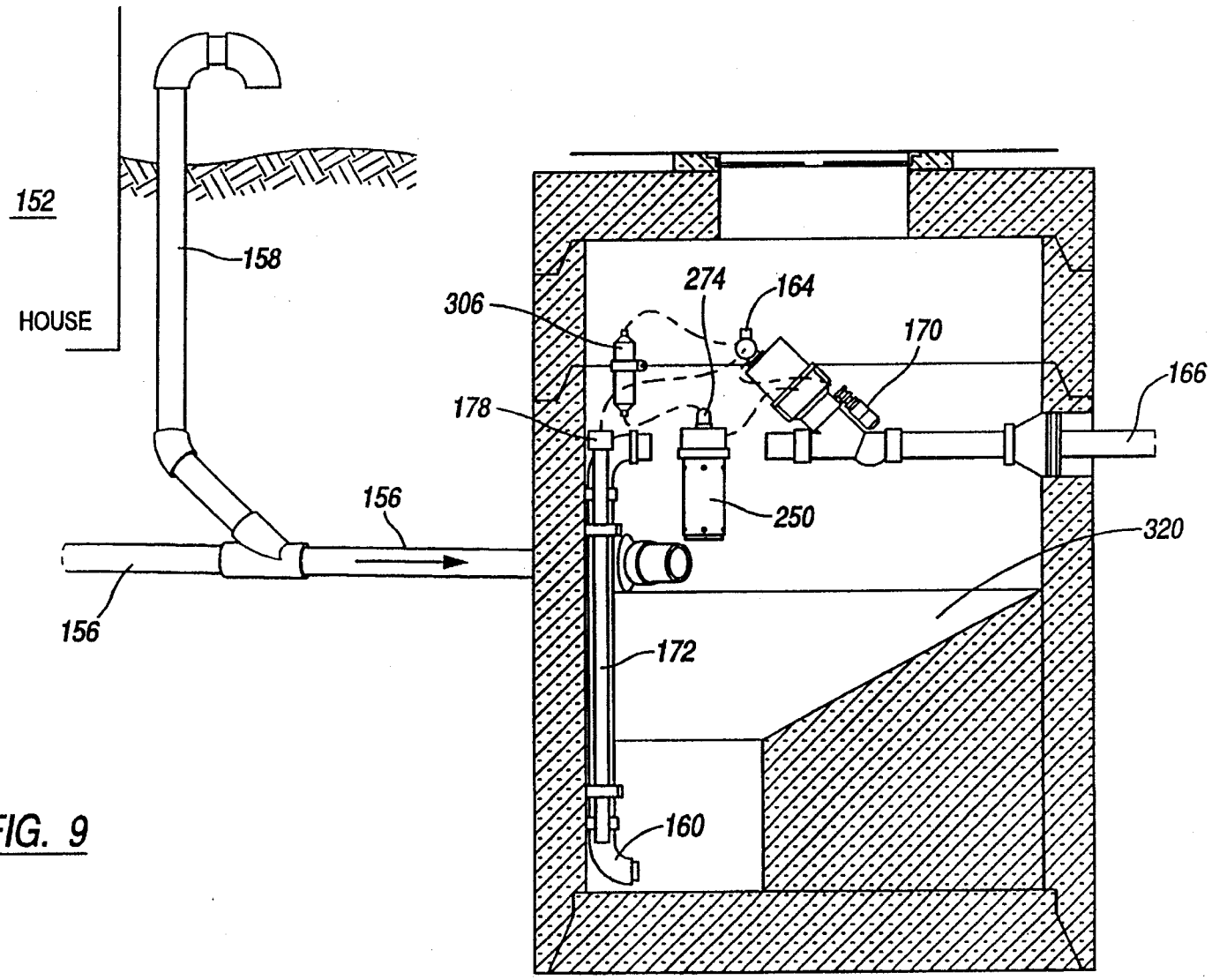

FIG. 6 is a diagrammatic representation of the vacuum sewerage system control mechanism of the present invention containing a float valve, and pressure-relief valve operatively connected to the sensor-controller;

FIG. 7 is a cross-sectional view of the float valve and pressure-relief valve of the present invention;

FIG. 8 is a diagrammatic representation of a gravity pipe with blocked dipped portion therein; and FIG. 9 is a diagrammatic representation of the vacuum sewerage system control mechanism installed in a buffer tank.

DETAILED DESCRIPTION OF THE PREFERRED EMBODIMENT

Figure 1:
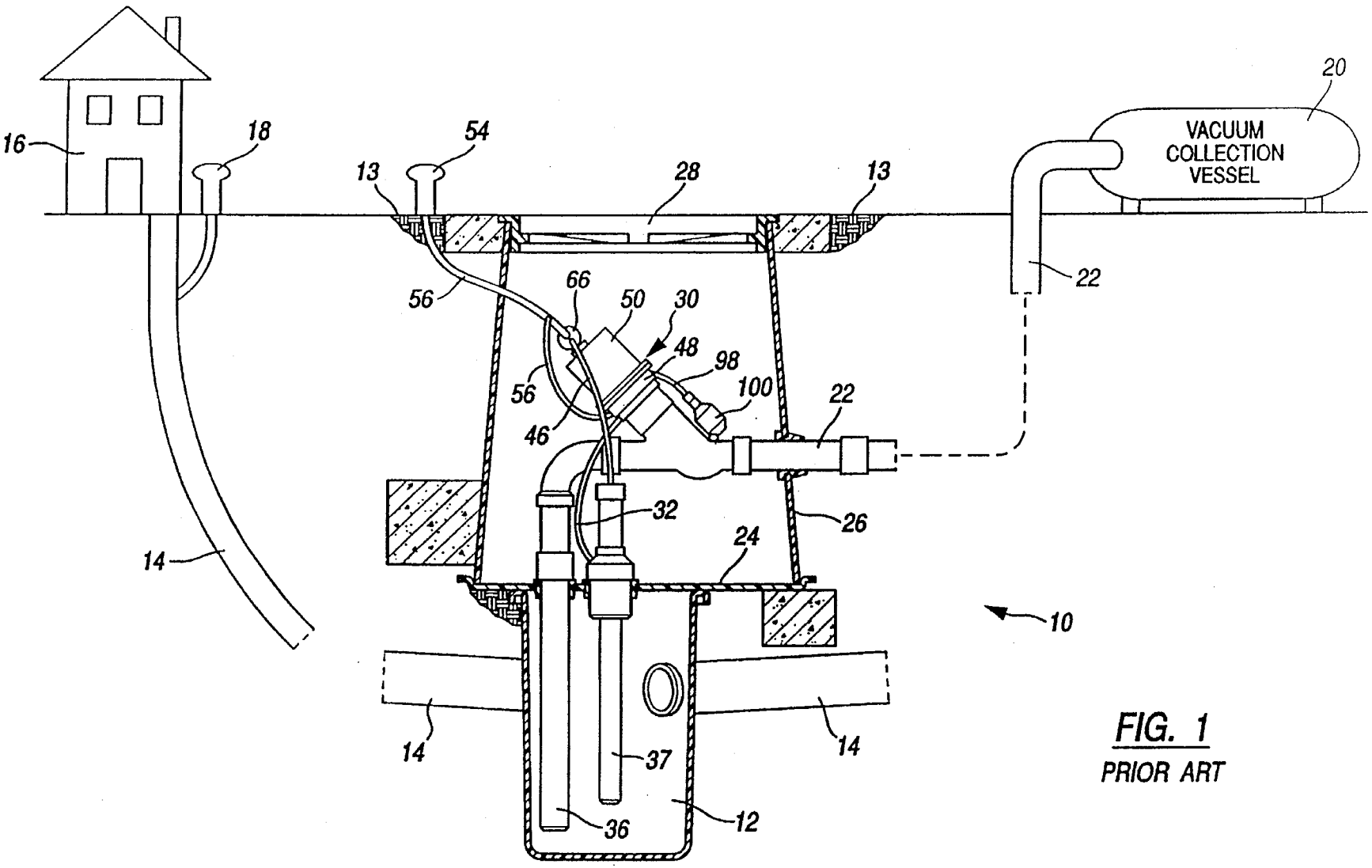
FIG. 1 PRIOR ART
FIG. 1 is a diagrammatic representation of a prior art vacuum sewerage transport system containing an interface valve, sensor-controller, and above-ground breather pipe.
Figure 2:
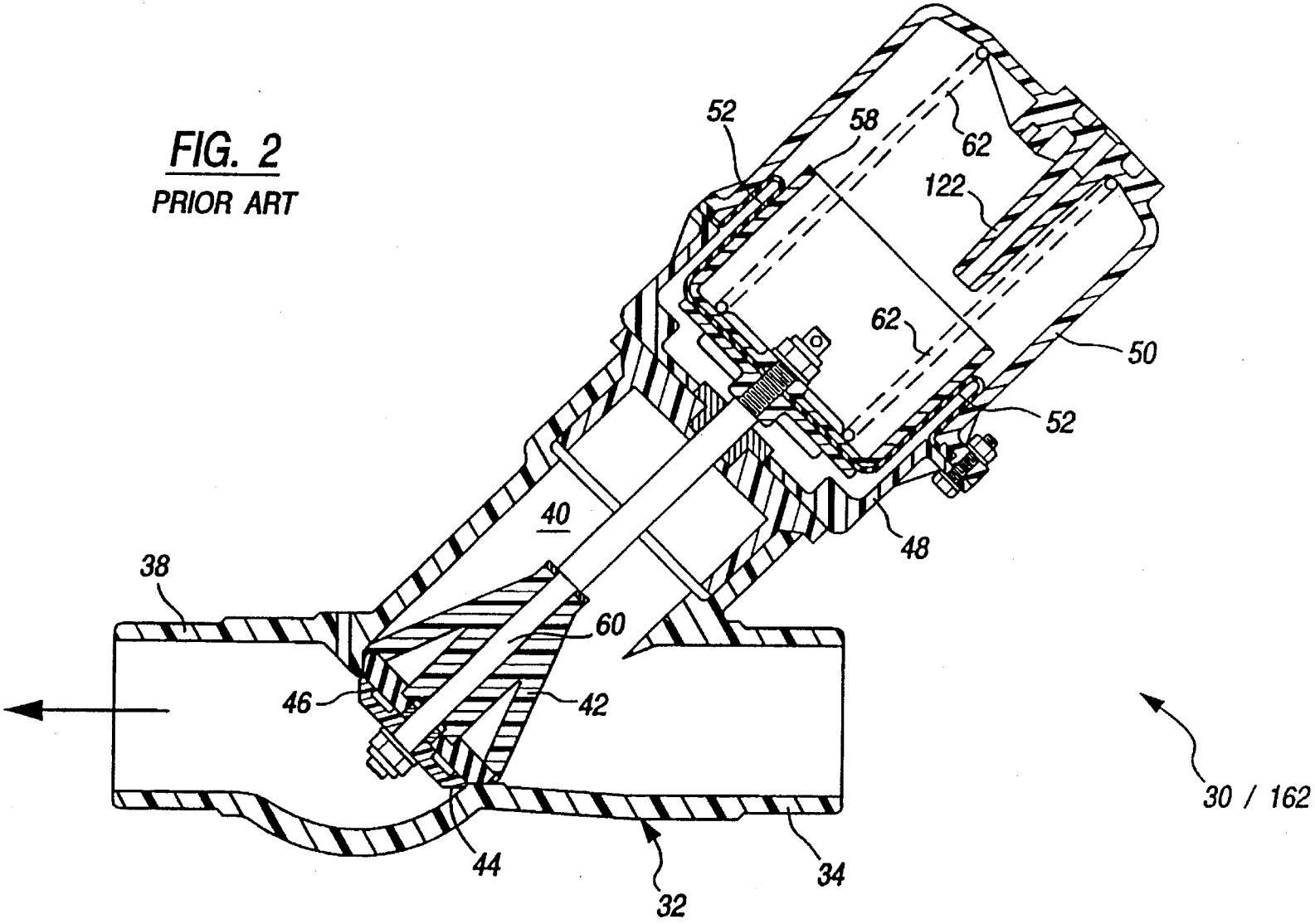
FIG. 2 PRIOR ART
FIG. 2 is a cross-sectional view of a prior art interface valve in the closed position.
Figure 3:
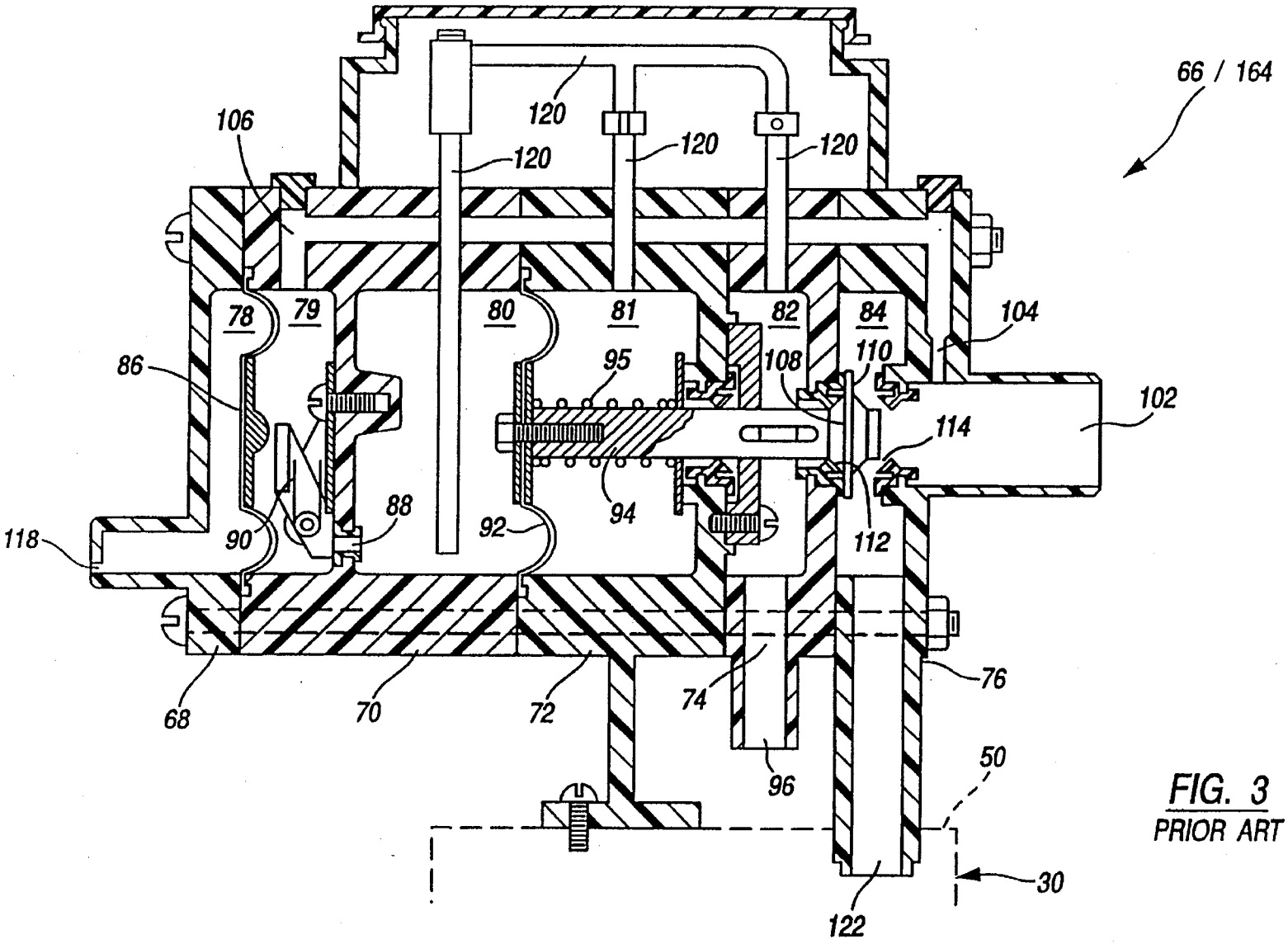
FIG. 3 PRIOR ART
FIG. 3 is a cross-sectional view of a prior art sensor-controller in the inactivated position.
Figure 4:
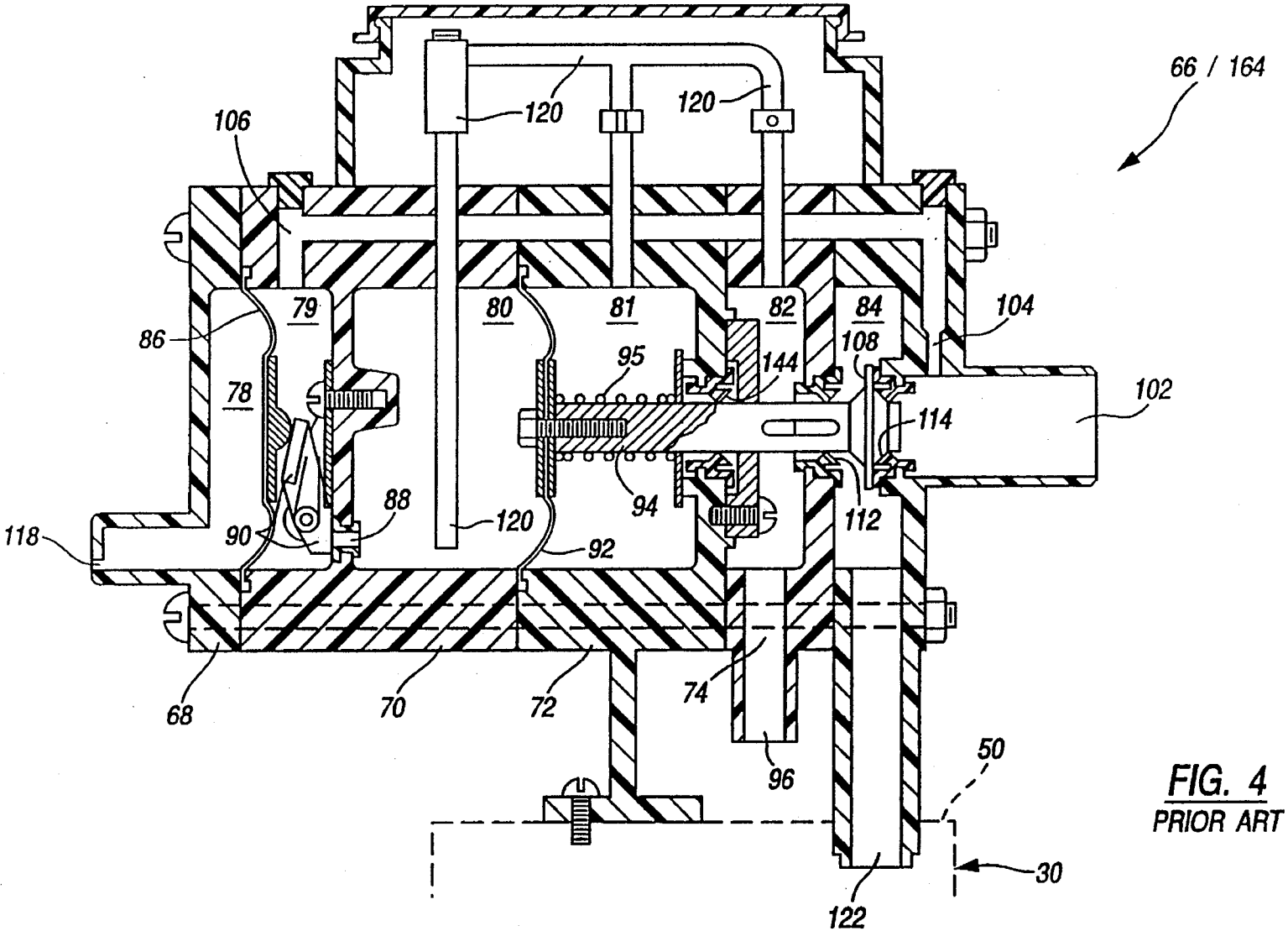
FIG. 4 PRIOR ART
FIG. 4 is a cross-sectional view of a prior art sensor-controller in the activated position.

The sump/valve pit assembly 150 of the present invention is illustrated in FIG. 6. Sewage is conveyed from a house, commercial establishment, etc. 152 to the sump pit 154 by means of gravity transport conduit 156. Gravity vent pipe 158 extending above ground introduces atmospheric pressure into gravity conduit 156 and thence into sump pit 154. Sewage is withdrawn from sump pit through discharge pipe 160 and an open vacuum interface valve 162 during a sewage transport cycle, as is known in the industry, and once interface valve 162 closes to terminate the transport cycle, sewage can no longer pass therethrough. A sensor-controller 164 in accordance with the structure of U.S. Pat. No. 4,373,838 is provided to operate interface valve, which is preferably designed in accordance with U.S. Pat. No. 5,082,238, and the same internal component numbers previously designated in FIGS. 2–4 will be used. Note that separate sensor and controller valves could be substituted for integrated sensor-controller 164, as taught by U.S. Ser. No. 07/829,742, now U.S. Pat. No. 5,259,427, 07/967,454, now U.S. Pat. No. 5,326,869, and 08/008,190, now U.S. Pat. No. 5,282,281, owned by the assignee of the present invention. Vacuum/subatmospheric pressure within vacuum transport conduit 166 is communicated via vacuum hose 168 to vacuum inlet 96 in sensor-controller 164. A surge tank 170 with a check valve may be interposed in vacuum line 168 in accordance with U.S. Pat. No. 4,171,853 to prevent residual sewage within vacuum transport conduit 166 from entering sensor-controller 164. Sensor pipe 172 extends through the top of sump pit 160 into valve pit 174 by means of sleeve 176. Cap 178 positioned on top of sensor pipe 172 provides a nipple 180 for operatively connecting sensor pipe 172 to inlet port 118 of sensor-controller 164 by means of pressure hose 182 in order to deliver hydrostatic pressure thereto from sump pit 154.

The float valve 250 of the present invention is shown in FIG. 9. It comprises a cylindrically shaped housing 252 made from a suitable material, such as 4-inch PVC pipe. Housing 252 is open at the bottom, and has mounted to its top surface a flat 4-inch cap 254 also made from PVC plastic. Attached to aperture 256 in cap 254 is slip adaptor 258 with body portion 260 depending inside housing 252, and collar 262 fitted adjacent to cap 254. Slip adaptor 258 has a bore 264 machined therethrough consisting of a cylindrically shaped upper region 266, yielding to another cylindrically shaped lower region 268 of larger diameter with a step 267 located at the transition point. A cylindrically shaped shaft seal 270 made from an elastomeric material is fitted along the bottom surface of slip adaptor 258, and at least partially along the surface of lower region 268 of bore 264.

The surface of upper cylindrical bore 266 has threads machined thereon, and screwed into engagement with the threads is one end of tee fitting 272 made from a plastic material like NYLON®. Secured to another end of tee fitting 272 is breather tee 274 with nipples (not shown) extending therefrom. Secured to the third threaded end 280 of tee fitting 272 is a NYLON® close nipple 282 and umbrella check valve 284 assembly.

Positioned inside housing 252 is float 286 made from, e.g., a 3-inch PVC Schedule 40 pipe with both ends welded shut. Float 286 is fitted with ballast material 288 to increase its weight. For example, if float 286 is 8⅝-inches long, then it should weigh at least 2 lbs. Secured along the exterior surface of float 286 are a plurality of PVC bosses 290 used to guide movement of float 286 along the axis X of housing 252. Mounted to the top surface 292 of float 286 by means of screw 294 is conically shaped seat 296, which may be machined from a plastic material like DELRIN®. The exterior dimensions of seat 296 should be such that the seat will sealingly engage the interior surface of shaft seal 270. Finally, a plurality of screws 298 protrude through housing side wall 252 into the interior volume thereof to prevent float 286 from becoming separated from float valve housing 252.

Float valve 250 is mounted to the ceiling of sump pit 154 so that cap 254, tee fitting 272, breather tee 274, and umbrella check valve 284 are positioned inside valve pit 174 out of contact with the sewage. A plurality of holes 300 in a portion of housing wall 252 inside sump pit 254 allow atmospheric air to enter float valve 250. Float 286 will rise due to buoyancy forces within housing 252 as the sewage level in sump pit 154 rises, but in no case will it fall below screw stops 298. When seat 296 is removed from shaft seal 270, the atmospheric air inside float valve 250 may pass through lower cylindrical bore 268, upper cylindrical bore 266, tee fitting 272, breather tee 274, and atmospheric hoses 302 and 304, respectively, to atmospheric port 102 of sensor-controller 164, and lower housing 48 of interface valve 162 to ensure their proper operation. A condensation trap 306 (FIG. 6) is preferably interposed in hose 302 to prevent condensed moisture from entering sensor-controller 164. Holes 300 likewise serve to permit atmospheric air to exit float valve housing 252, so that float 286 may be forced higher inside housing 252 to allow additional sewage to enter sump pit 154 while sensor-controller 164 and interface valve 162 remain inoperative during, e.g., prolonged low vacuum conditions.

Once the sewage level inside sump pit 154 reaches a predetermined level, however, seat 296 on float 286 will penetrate lower cylindrical region 268 of bore 264 and abut shaft seal 270 in sealing engagement so that sewage cannot be drawn through breather tee 274 and hose 302 once sensor-controller 164 is activated after full vacuum is restored to the system.

Once full vacuum is restored and sensor-controller 164 opens interface valve 162 to evacuate the sewage in sump pit 154, then float 286 will fall with the declining sewage level. Seat 296 will be removed from shaft seal 270 to once again allow atmospheric air to enter breather tee 274. Float valve 250 provides a time delay function by remaining closed while the vacuum level is restored and sewage evacuation commences. Float valve 250 will only open once the sewage level falls to a predetermined level, so that atmospheric air—and no sewage—can enter breather tee 274, hoses 302 and 304, and sensor-controller 164 and interface valve 162.

While atmospheric pressure is shut off to sensor-controller 164 by float valve 250, any atmospheric pressure in valve chamber 84 will leak through outlet vent 122. Once full vacuum is restored to the system and communicated to vacuum chamber 82, and sensor-controller 164 is activated in response to the elevated hydrostatic pressure level in sump pit 154, the vacuum pressure will leak through vacuum vent 112, atmospheric vent 114, and atmospheric inlet 102 back through hose 302 and tee 274 into the top interior volume of float valve housing 252. Thus, the weight of float 286 must be such that it can overcome the vacuum pressure temporarily applied to its top surface 292 so that float 286 may drop in response to the receding sewage level in sump pit 154. Ballast material 288 inside float 286 ensures that this occurs.

If gravity line 156 develops a dip 310 through improper installation or settling over time, it can become filled with sewage 312, as shown in FIG. 10, so that atmospheric pressure can no longer be communicated by breather pipe 158 to sump pit 154, and through open float valve 250 to sensor-controller 164 and interface valve 162. This could lead to the situation wherein increased hydrostatic pressure passes through hoses 182 and 302 to both ends of sensor-controller 164, which will ensure that the sensor-controller cannot properly operate. Therefore, close nipple 282 and umbrella check valve 284 are combined to form a pressure relief valve 285 that harmlessly vents the hydrostatic pressure above a predetermined level into valve pit 174 to ensure that sensor-controller 164 can continue to operate interface valve 162 in a normal manner.

FIG. 9 shows installation of the vacuum sewerage transport control system in a buffer tank 320 in which like elements bear the same numbers. The installation and operation are the same as for the sump/valve pit of FIG. 6 except that a buffer tank is not a sealed system, for any gases may be vented through manhole cover 322. Thus, a pressure-relief valve need not be installed on tee 274 of float valve 250.

While particular embodiments of the invention have been shown and described, it should be understood that the invention is not limited thereto, since many modifications may be made. The invention is therefore contemplated to cover by the present application any and all such modifications which fall within the true spirit and scope of the basic underlying principles disclosed and claimed herein.

What is claimed is:

1. An apparatus for regulating the transport of sewage from a source to a transport conduit and associated collection station normally maintained at vacuum or subatmospheric pressure, the apparatus comprising:

a. a sewage accumulation receptacle installed underground and connected to the sewage source by conduit means for collecting sewage prior to discharge to the transport conduit;

b. said receptacle being adapted for connection to conduit means communicating with a remote substantially atmospheric pressure source to maintain said receptacle before and after discharge generally at a pressure level above the normal vacuum or subatmospheric pressure of the sewage transport conduit;

c. a differential pressure-operated sensor means operatively in communication with said receptacle for establishing communication of atmospheric or vacuum/subatmospheric pressure as an output pressure condition, said sensor means having a first inactivated condition, and a second activated condition arising when the sewage collected in said receptacle reaches a predetermined volume, whereby vacuum or subatmospheric pressure is delivered while said sensor means is in one condition, and whereby atmospheric pressure is delivered while said sensor means is in another condition, the atmospheric pressure being provided by conduit means in operative communication with said receptacle without an air vent openly protruding above ground level;

d. a differential pressure-operated controller means operatively in communication with the output pressure condition delivered by said sensor means for establishing communication of atmospheric or vacuum/subatmospheric pressure as an output pressure condition, said controller means having a first condition and a second condition, whereby vacuum or subatmospheric pressure is delivered while said controller means is in one condition, and whereby atmospheric pressure is delivered while said controller means is in another condition, the atmospheric pressure being provided by conduit means in operative communication with said receptacle without an air vent openly protruding above ground level;

e. conduit means operatively connecting said sensor means and controller means to the vacuum/subatmospheric pressure of the sewage transport conduit;

f. a differential pressure-operated flow control means operatively in communication with the output pressure condition delivered by said controller means, said flow control means having an open condition to permit passage of sewage from said receptacle to the transport conduit and thereby commence a sewage transport cycle therein, said flow control means also having a closed condition to block passage of sewage therethrough, thereby terminating the transport cycle, whereby said flow control means converts between the open and closed conditions based upon the pressure condition delivered by said controller means; and g. atmospheric vent valve means for inhibiting passage of sewage collected within said receptacle through said conduit means for providing atmospheric pressure from said receptacle to said sensor means and said controller means when the vacuum/subatmospherie pressure condition delivered thereto by said vacuum/subatmospheric pressure conduit rises above a predetermined minimum level.

2. A sewage transport regulatory apparatus as recited in claim 1, wherein said atmospheric vent valve means comprises:

a. a housing positioned inside said receptacle, and fixed in relation thereto, said housing being open at the bottom and having a cap connected to its top surface with a liquid and pressure-tight seal;

b. a breather pipe having an inlet and an outlet, and c. connected to an aperture in the cap of said housing for venting atmospheric pressure contained inside said housing to conduit means connected to said sensor means and said controller means; and means for closing the breather tube inlet of said atmospheric vent valve means when the sewage collected in said receptacle exceeds a predetermined volume.

3. A sewage transport regulatory apparatus as recited in claim 2, wherein said means for closing the breather tube inlet comprises a buoyant float contained inside said atmospheric vent valve housing, said float having a protruded seat extending from its top surface that engages the inlet of said breather tube when the sewage level in said receptacle rises above a predetermined level to prevent passage of sewage through the inlet opening, and disengages the inlet opening once sewage is discharged from said receptacle by said flow control means upon recovery of full vacuum by said transport conduit.

4. A sewage transport regulatory apparatus as recited in claim 3, further comprising protrusions extending inwardly from said atmospheric vent valve housing near its bottom end for preventing separation of said float from said housing once the sewage level in said receptacle falls below said atmospheric vent valve.

5. A sewage transport regulatory apparatus as recited in claim 3, further comprising protrusions extending outwardly from said float for guiding axial movement of said buoyant float within said atmospheric vent valve housing as the level of the sewage inside said receptacle rises and falls to ensure proper alignment between said protruded seat and said breather tube inlet.

6. A sewage transport regulatory apparatus as recited in claim 3, further comprising a shaft seal attached to the surface of said breather tube inlet for providing an enhanced seal when engaged by said protruded seat of said float.

7. A sewage transport regulatory apparatus as recited in claim 3, further comprising ballast material added to the interior of said float to increase the weight of said float in order to overcome the forces applied by vacuum or subatmospheric pressure that may be communicated to a region of said atmospheric vent valve means between said float and said cap by said controller means in a reverse flow through said breather pipe.

8. A sewage transport regulatory apparatus as recited in claim 2 further comprising apertures formed in the side of said atmospheric vent valve housing for facilitating passage of atmospheric air inside and outside said housing.

9. A sewage transport regulatory apparatus as recited in claim 1, wherein said atmospheric vent valve means further comprises a pressure-relief valve extending from said breather pipe outside of said sewage collection receptacle for venting hydrostatic pressure contained within said receptacle above a predetermined limit.

10. A sewage transport regulatory apparatus as recited in claim 9, wherein said pressure-relief valve comprises an umbrella check valve.

11. A sewage transport regulatory apparatus as recited in claim 1, further comprising a surge tank with a check valve interposed within said vacuum/subatmospheric pressure conduit means to inhibit passage of sewage therethrough from the transport conduit.

12. A sewage transport regulatory apparatus as recited in claim 1, further comprising a condensation trap interposed within said atmospheric pressure communication conduit between said atmospheric vent valve means and said controller means to inhibit passage of condensed moisture into said or controller means.

13. A sewage transport regulatory apparatus as recited in claim 1, further comprising conduit means between said sensor means and said receptacle for communicating the hydrostatic pressure level within said receptacle to said sensor means, wherein a differential pressure operated parts assembly inside said sensor means is calibrated to be activated once the sewage level in said receptacle exceeds a predetermined volume.

14. A sewage-transport regulatory apparatus as recited in claim 1, wherein said sensor means and controller means are combined within a single unit.

15. A sewage-transport regulatory apparatus as recited in claim 1, wherein atmospheric pressure is provided to said differential pressure-operated flow control means by conduit means in operative communication with said receptacle without an air vent or other conduit openly protruding above ground level.

* * * * *